United States Patent [19]

Roberts

[11] Patent Number: 4,902,933

[45] Date of Patent: Feb. 20, 1990

[54] HIGH EFFICACY DISCHARGE LAMP HAVING LARGE ANODES

[75] Inventor: Victor D. Roberts, Burnt Hills, N.Y.

[73] Assignee: General Electric Company, Schenectady, N.Y.

[21] Appl. No.: 246,605

[22] Filed: Sep. 20, 1988

[51] Int. Cl.[4] ..... H01J 17/34; H05B 41/14

[52] U.S. Cl. ..... 315/94; 315/32; 315/71; 313/632

[58] Field of Search ..... 315/32, 69, 71, 94, 315/101; 313/631, 632

[56] References Cited

U.S. PATENT DOCUMENTS

| | | | |
|---|---|---|---|
| 1,990,192 | 2/1935 | Lems | 176/122 |
| 1,994,726 | 3/1935 | Orth | 250/27.5 |
| 1,997,693 | 4/1935 | Lowry | 250/27.5 |
| 2,444,397 | 6/1948 | Cram | 176/122 |
| 2,930,919 | 3/1960 | Wainio | 313/109 |
| 3,215,882 | 11/1965 | Toomey | 313/109 |
| 3,376,457 | 4/1968 | Hoeh | 313/205 |
| 3,614,506 | 10/1971 | Evans | 313/174 |
| 4,032,813 | 6/1977 | Shurgan et al. | 313/492 |
| 4,093,893 | 6/1978 | Anderson | 315/48 |
| 4,298,813 | 11/1981 | Johnson | 313/229 |
| 4,329,622 | 5/1982 | Corona et al. | 315/49 |

FOREIGN PATENT DOCUMENTS

| | | | |
|---|---|---|---|
| 0103765 | 6/1983 | Japan | 315/71 |

OTHER PUBLICATIONS

Waymouth, John F., *Electric Discharge Lamps*, M.I.T. Press, 1978, pp. 71–75.

*Primary Examiner*—David Mis

*Attorney, Agent, or Firm*—Jill M. Breedlove; James C. Davis, Jr.; Marvin Snyder

[57] ABSTRACT

An electric discharge lamp having two distinct electrode pairs, each pair including a "large" anode, is provided to eliminate the voltage drop between the positive column and the electrodes. A diode is wired in series with each electrode to prevent electron emission from the enlarged anodes. The combination results in a lamp with higher efficacy.

14 Claims, 1 Drawing Sheet

HIGH EFFICACY DISCHARGE LAMP HAVING LARGE ANODES

FIELD OF THE INVENTION

The present invention relates generally to discharge lamps. More particularly, this invention relates to a high-efficacy discharge lamp having anodes of sufficiently large surface area to avoid the voltage drop, or anode fall, between the positive column and the electrodes, while preventing electron emission from the enlarged anodes.

BACKGROUND OF THE INVENTION

Conventional electroded discharge lamps have three distinct discharge regions: the anode region; the cathode region; and the positive column between the two electrode regions. Radiation from the positive column accounts for most of the light produced by most discharge lamps. In contrast, the electrode regions generate light, if any, with significantly lower efficacy than that of the positive column. Therefore, the overall efficacy of a discharge lamp can be increased by increasing the percentage of total power delivered to the positive column, while decreasing the percentage of total power delivered to the electrode regions. The power delivered to the positive column is the product of the lamp current and the voltage drop across the positive column. Similarly, the power delivered to each of the two electrode regions is the product of the lamp current and the voltage drop between the positive column and each electrode. Therefore, since the same lamp current flows through all three discharge regions, the goal of reducing power loss in the electrode regions becomes the goal of reducing the voltage drop in the electrode regions relative to the voltage drop in the positive column.

It is well-known that the magnitude of the anode fall is dependent on the size of the anode. The reason is that the negative space charge about the anode, which accounts for the voltage drop, decreases as anode surface area increases. Electrons, therefore, require less energy to overcome the repulsive force of the space charge at the anode. Hence, the magnitude of the anode fall decreases as anode size increases. However, since a single electrode serves as an anode and as a cathode on alternate half cycles of the operating alternating current, cathode design considerations have heretofore prevented the mere enlargement of the electrodes of the discharge lamp. In fact, electrode design has heretofore been optimized for operation as a cathode due to its critical role as an electron emitter, while anode operation has been deemed the secondary consideration. More specifically, a cathode of large surface area is undesirable because the cathode must heat to thermionic electron emitting temperatures rapidly at the start of lamp operation in order to avoid destructive sputtering. Therefore, with cathode design as the foremost consideration, the electrodes are not large enough to collect electrons during the anode cycle which are moving at their thermal velocity in the discharge plasma, thus necessitating the inducement of an accelerating field between the plasma and the anode, or inducement of the anode fall.

In a standard fluorescent lamp, for example, electrons are emitted from the portion of the tungsten electrode which has been coated with a low work function electron-emitting substance well-known in the art, such as an alkaline earth oxide. When the same electrode operates as an anode, electrons are collected on the portion of the tungsten electrode which has not been coated with the electron-emitting substance and also on the uncoated electrode support wires. The power consumed when electrons are collected is equal to the product of the anode fall and the lamp current. This power heats the portion of the electrode where electrons are collected. Most of this power is wasted because the collecting portion of the electrode differs structurally from the emitting portion so as to emit light with relatively low efficiency. Further, in high current lamps, the power dissipated during the anode cycle can heat parts of the electrode structure to undesirable high temperatures. Additional wire anodes are, therefore, welded to the electrode in some high current fluorescent lamps to increase anode surface area, thereby reducing the temperature of the anode. These wire anodes, however, do not avoid the anode fall.

The electrode structure in high intensity discharge lamps differs from that in fluorescent lamps, but the basic operation is similar. That is, a single electrode serves as both the anode and the cathode; the design, therefore, is optimized for cathode operation.

Enlarged anodes or shield means have been employed in some discharge lamps to reduce the anode fall. These structures generally comprise an additional grid-like or shield-like member mounted in proximity with the lamp electrode which serves both the cathode and anode functions. However, these lamps are not widely used for several reasons. Foremost is the problem of the enlarged anode, or additional structure, acting as a cathode during cathode operation. For instance, upon starting the lamp, the anode may act as a cold cathode until the cathode becomes hot enough to emit electrons in the thermionic mode. This initial cold cathode operation causes sputtering from the anode and, thus, darkening of the lamp walls. Further, emission material which evaporates or sputters from the cathode deposits on the anode, thus making cathode operation of the anode with resultant sputtering more likely. The effect of sputtering is a reduction in light output of the lamp. Although the anode fall of these lamps may be reduced, it is not avoided. The overall energy saving of these lamps is minimal, if any.

OBJECTS OF THE INVENTION

It is, therefore, an object of the present invention to provide a new and improved electric discharge lamp having anodes of sufficiently large surface area to collect the lamp operating current by thermal diffusion of the discharge electrons to the anode surface, thus operating without an accelerating potential between the plasma and the anode, thereby increasing lamp efficacy.

Another object of the present invention is to provide a new, improved AC discharge lamp having two distinct pairs of electrodes, each pair including an enlarged anode and a cathode, each electrode design being optimized to increase lamp efficacy.

Still another object of this invention is to provide an improved discharge lamp having two electrode pairs, each pair including a large anode, and further having means to prevent the anodes from operating as cathodes during cathode operation in order to avoid destructive sputtering.

SUMMARY OF THE INVENTION

These and other objects of the present invention are achieved by a new, high-efficacy discharge lamp having anodes which are significantly larger than those used in conventional discharge lamps. In accordance with the invention, the new discharge lamp has two distinct electrode pairs, each including an anode of sufficiently large surface area to avoid the voltage drop, or anode fall, between the positive column and the electrodes, thereby increasing lamp efficacy.

In the preferred embodiment, the enlarged anode comprises a disk having an oval hole formed centrally therein for accommodating the cathode. Preferably, the disk is constructed from a low-cost, highly reflective metal which will not react with mercury. Additionally, the metal must be able to withstand high manufacturing temperatures. A suitable metal having these characteristics is nickel. In another version of the new discharge lamp, the enlarged anode is an oval metal band surrounding the cathode.

Further, in accordance with the present invention, a diode is wired in series with each anode to prevent the anodes from operating as cathodes during cathode operation thereby avoiding destructive sputtering.

The features and advantages of the present invention will become apparent from the following detailed description of the invention when read with the accompanying drawings.

DETAILED DESCRIPTION OF THE INVENTION

Figure 1:
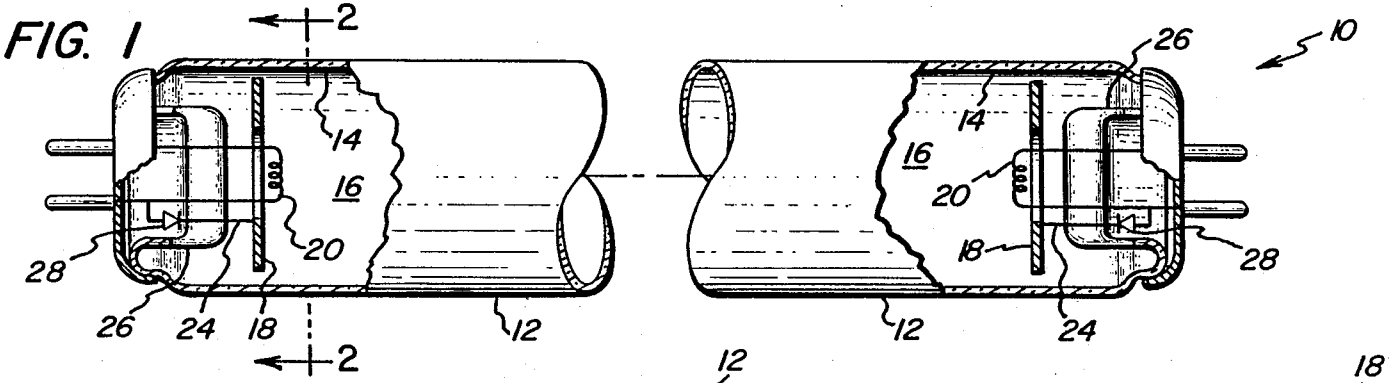
FIG. 1 is an elevational fragmentary view of a fluorescent lamp constructed in accordance with the present invention.
Figure 2:
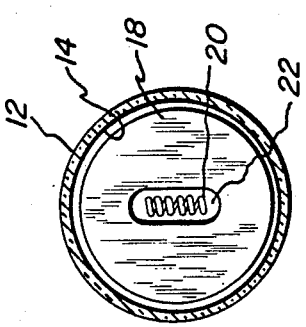
FIG. 2 is a cross-sectional view taken on line 2—2 in FIG. 1.

With reference to FIGS. 1 and 2, the preferred embodiment of a fluorescent lamp constructed in accordance with the present invention is shown, generally designated by the numeral 10. Fluorescent lamp 10 includes a light-transmissive envelope 12 which has an interior phosphor coating 14 and is tubular. However, other cross-sectional shapes can be used. Like conventional fluorescent lamps, envelope 12 is evacuated and contains an excess amount of mercury. Additionally, within envelope 12, a gaseous discharge medium 16 is enclosed. This gaseous discharge medium is selected from the group of noble gases consisting of neon, krypton and argon, and mixtures thereof.

A pair of electrodes 18,20 is located at each end of the envelope 12. Each electrode pair comprises an anode 18 and a cathode 20. According to the present invention, each anode 18 has a sufficiently large surface area to avoid the voltage drop between the positive column of the discharge (not shown) and the anode 18, this voltage drop hereinafter referred to as the anode fall.

In the preferred embodiment of the present invention, as shown in FIGS. 1 and 2, the enlarged anodes 18 comprise metal disks. Each disk has an oval hole 22 for mounting its corresponding cathode 20. The enlarged anodes 18 are each mounted by means of at least one wire 24 held securely to the crimp 26 of the lamp 10. Preferably, the disks 18 are constructed of a low-cost, highly light-reflective metal which will not react with mercury. Additionally, the metal must be capable of withstanding high manufacturing temperatures. A suitable metal having these characteristics is nickel. As shown, the metal disks 18 are mounted slightly behind the cathodes 20 to avoid interference with cathode operation.

Figure 4:
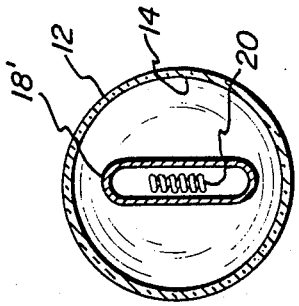
FIG. 4 is a cross-sectional view taken on line 4—4 in FIG. 3.
Figure 3:
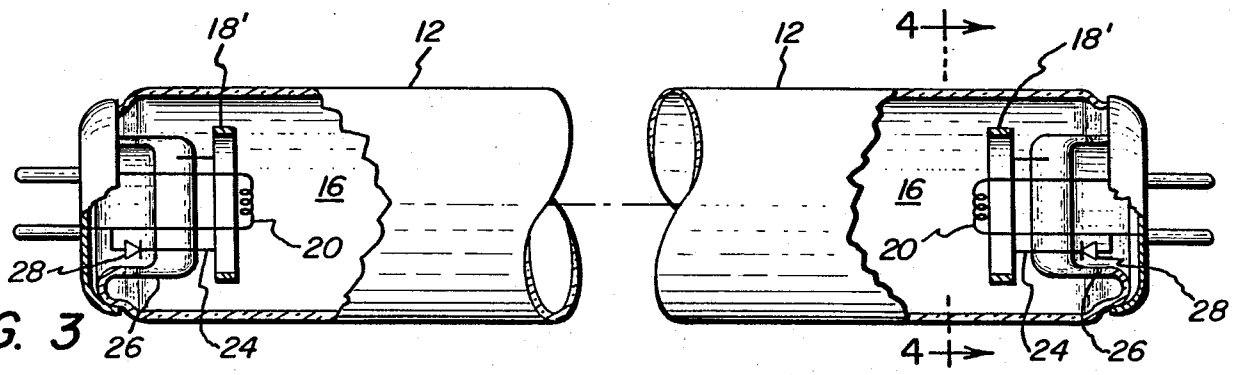
FIG. 3 is an elevational fragmentary view of another embodiment of a fluorescent lamp constructed in accordance with the present invention.

In an alternate embodiment, as shown in FIGS. 3 and 4, each enlarged anode 18' comprises an oval metal band surrounding or adjacent to its corresponding cathode 20. Although only two structural forms of the enlarged anode 18,18' are described herein, it is contemplated that the principles of this invention may be applied to enlarged anodes of different configurations.

Because the lamp 10 of the present invention has separate anodes and cathodes, rather than the single electrode structure of conventional lamps, optimum anode size is determined without regard to cathode operation. As noted by John F. Waymouth in *Electric Discharge Lamps,* M.I.T. Press, 1978, p. 72, electrons exhibiting positive column behavior have a spherically symmetric Maxwellian velocity distribution. These electrons, typically, have a mean energy of approximately 1 volt and a corresponding temperature of approximately 11,400° K. According to Maxwellian statistics, if a flat plate of surface area, A, is placed in a discharge plasma and maintained at the potential of the plasma, then a random current, $i_R$, of electrons, due to random thermal motion of the electrons, is collected and can be calculated from the following formula:

$$i_R = en_e\sqrt{\frac{\kappa T_e}{2\pi m_e}}\ A$$

In the above formula: e is the electron charge ($1.602\times10^{-19}$ coulombs); $n_e$ is the electron density (approximately $2=10^{17}/m^3$); $\kappa$ is Boltzman's constant ($1.381=10^{-23}$ joules/°K.); $T_e$ is the electron temperature (approximately 11,400° K.); and $m_e$ is the electron mass ($9.107\times10^{31\ 31}$ Kg).

According to the present invention, if an anode of surface area, A, calculated according to the above equation, is used, then the anode surface area is sufficiently large to collect electrons moving at their thermal velocity in the discharge plasma. Thus, the need for an accelerating field between the plasma and the anode, or the anode fall, is avoided.

In the preferred embodiment, the disk is made sufficiently large so that a single surface provides the area A in the above equation.

To illustrate, a lamp operating at a current of 0.43 amperes requires an anode having a single-side surface area approximately equal to 0.79 $cm^2$ in order to eliminate the anode fall. This translates to a solid disk diameter of about 1 cm. Because the construction of an anode 18 in accordance with the present invention has a hole 22 to accommodate the cathode 20, the above calculated diameter of the anode disk must be increased in order to compensate for the cathode hole area. The area of the oval band-shaped anode 18' of the alternate embodiment is also calculated from the above formula for $i_R$.

In accordance with the present invention, a diode 28 is wired in series with each anode 18,18' to prevent the anodes from emitting electrons during cathode operation. Without these diodes 28, undesirable cathode operation of the anodes occurs primarily in two instances. First, upon starting the lamp, the metal anode may act as a cold cathode until the cathode becomes hot enough to emit electrons in the thermionic mode. This initial cold cathode operation causes sputtering from the anode and, thus, darkening of the lamp walls. Second, emission material which evaporates or sputters from the cathode deposits on the anode, thus making cathode operation of the anode with resultant sputtering more likely.

While the preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

What is claimed is:

1. An electric discharge lamp, comprising:

a light-transmissive envelope containing a gaseous discharge medium;

two spaced pairs of electrodes sealed within said envelope, each electrode pair comprising an enlarged anode in proximity with a cathode, the surface area of each said enlarged anode being sufficiently large to avoid any voltage drop between the positive discharge column and each said enlarged anode during lamp operation; and electronic means to prevent electron emission from the surface of each said enlarged anode.

2. The electric discharge lamp of claim 1 wherein said electronic means comprises a diode wired in series with each of said enlarged anodes, respectively, such that the negative terminal of each of said diodes, respectively, is electrically connected to one of said enlarged anodes, respectively, and the positive terminal of each of said diodes, respectively, is electrically connected to the corresponding cathode of the corresponding one of said electrode pairs.

3. The electric discharge lamp of claim 1 wherein each of said enlarged anodes comprises a light-reflective metal disk, each said disk having a hole formed therein for mounting a respective one of the cathodes therein.

4. The electric discharge lamp of claim 2 wherein said metal comprises nickel.

5. The electric discharge lamp of claim 1 wherein each said enlarged anode comprises an oval light-reflective metal band surrounding its corresponding cathode.

6. The electric discharge lamp of claim 5 wherein said metal comprises nickel.

7. The electric discharge lamp of claim 1 wherein said envelope is tubular in shape and wherein said two electrode pairs are mounted at opposite ends thereof.

8. A fluorescent discharge lamp, comprising:

a light-transmissive envelope containing a gaseous discharge medium, said light-transmissive envelope having a phosphor coating on the interior surface thereof;

two spaced pairs of electrodes sealed within said envelope, each electrode pair comprising an enlarged anode in proximity with a cathode, the surface area of each said enlarged anode being sufficiently large to avoid any voltage drop between the positive discharge column and each said enlarged anode during lamp operation; and electronic means to prevent electron emission from the surface of each said enlarged anode.

9. The lamp of claim 8 wherein said electronic means comprises a diode wired in series with each of said enlarged anodes, respectively, such that the negative terminal of each of said diodes, respectively, is electrically connected to one of said enlarged anodes, respectively, and the positive terminal of each of said diodes, respectively, is electrically connected to the corresponding cathode of the corresponding one of said electrode pairs.

10. The fluorescent lamp of claim 8 wherein each of said enlarged anodes comprises a light-reflective metal disk, each said disk having a hole formed therein for mounting a respective one of said cathodes therein.

11. The fluorescent lamp of claim 10 wherein said metal comprises nickel.

12. The fluorescent lamp of claim 8 wherein each said enlarged anode comprises an oval, light-reflective metal band surrounding its corresponding cathode.

13. The fluorescent lamp of claim 12 wherein said metal comprises nickel.

14. The fluorescent lamp of claim 8 wherein said gaseous discharge medium is selected from the group consisting of neon, krypton and argon, including mixtures thereof.

* * * * *